United States Patent [19]

Brimer

[11] 4,007,612

[45] Feb. 15, 1977

[54] WASHING MACHINE BALANCE AND SUSPENSION SYSTEM

[75] Inventor: Claude Morris Brimer, Tucson, Ariz.

[73] Assignee: Linear International Corporation, Rancho La Costa, Calif.

[22] Filed: Aug. 18, 1975

[21] Appl. No.: 605,624

[52] U.S. Cl. ..... 68/23.2; 68/23.3; 210/363

[51] Int. Cl.[2] ..... D06F 37/24

[58] Field of Search ..... 68/23.2, 23.3; 210/144, 210/363, 364, 365, 367; 233/1 C, 23 A

[56] References Cited

UNITED STATES PATENTS

| | | | |
|---|---|---|---|
| 2,538,246 | 1/1951 | Holm-Hansen | 68/23.2 X |
| 2,683,364 | 7/1954 | Kirby | 68/23.2 |
| 2,700,473 | 1/1955 | Emmert et al. | 68/23.2 X |
| 2,969,172 | 1/1961 | Hutt | 68/23.2 X |
| 3,268,082 | 8/1966 | Galin | 210/364 |

*Primary Examiner*—Philip R. Coe
*Attorney, Agent, or Firm*—Lockwood, Dewey, Zickert & Alex

[57] ABSTRACT

An improved washing machine of simplified construction including means for stabilizing same during the fluid extraction or spin portion of its operation cycle. When a spin basket therein rotates at high speed the stabilization means counteracts the imbalance in the basket caused by clothes placed therein. The means for stabilizing the washing machine includes in combination: a fluid retaining jacket surrounding the spin basket and in fluid communication therewith for obtaining fluid extracted therefrom and retaining a portion therein by centrifugal force; and a plurality of flexible casing mounting support bars generally vertically positioned in spatial relation inside the washing machine casing adjacent its external corners. Each of the bars is rigidly mounted at its top end to the casing inwardly adjacent the top thereof and extends substantially freely downwardly through the casing. At the bottom end of each support bar foot pads of resilient material are mounted thereon for providing frictional contact with a mounting surface for the washing machine.

10 Claims, 3 Drawing Figures

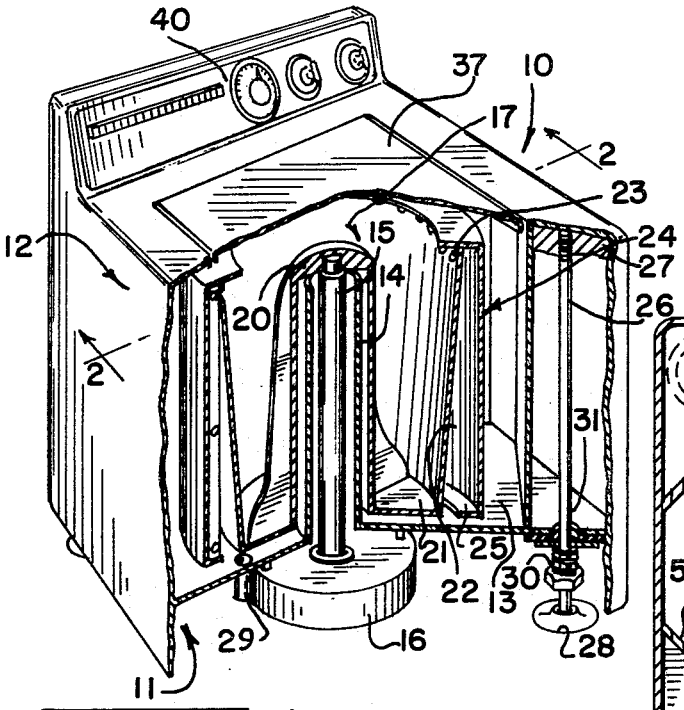
FIG. 1
FIG. 3
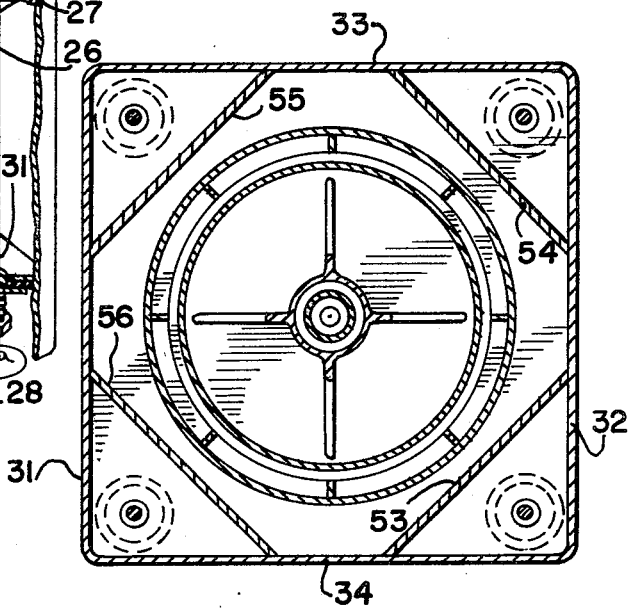
FIG. 2
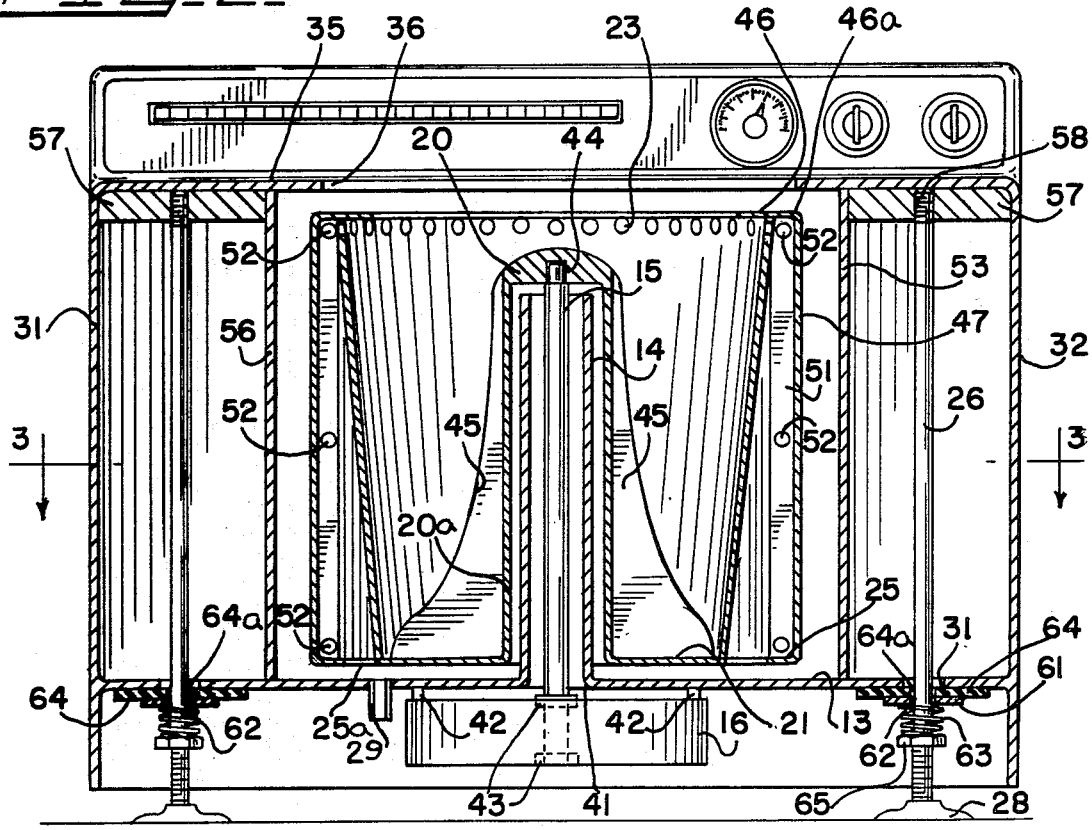

WASHING MACHINE BALANCE AND SUSPENSION SYSTEM

BACKGROUND OF THE INVENTION

This invention relates to clothes washing machines and, more particularly, to a simplified construction for small and conventional size washing machines which provides vibration damping during its spin cycle when the tub rotates at high speed. The invention combines a vibration damping means for supporting the entire washing machine together with a centrifugally operated balance seeking water retention means on the clothes receiving tub or spin basket. Also, the simplified construction of the invention allows the tub and the outer casing of the washing machine to be formed of injection molded plastic material. Therefore, the cost of manufacture of the invention is lower than in known washing machines of like sizes and capacity.

Heretofore known washing machines have utilized various means for stabilizing the structure during its operation. Washing machines tend to become most unstable during the spin cycle wherein the oscillating motion of the tub is changed to a rotating motion for extracting water therefrom. During this spin cycle, the clothes inside the tub are commonly in random position around the center of tub rotation. An imbalance is then created during rotation which, if not compensated for, results in severe vibration of the entire washer.

Known vibration damping means for washing machine spin cycles include a water retaining ring surrounding the outside of the clothes receiving tub. This water retaining ring receives water which is centrifuged from the tub during the spin cycle and retains the water therein due to the same centrifugal action. The retained water provides a heavy mass positioned farther away from the axis of rotation than any other portion of the tub. This large liquid mass seeks a position in the ring which tends to compensate for the imbalance in the rotating tub thereby lessening the vibration. As the spin cycle of the washing machine is completed and the tub rotation slows, the fluid mass, at a critical speed, ceases to be retained against the outer ring wall and exits the ring through an open bottom therein. Heretofore known water retaining rings have been of expensive metal fabrication. Applicant's spin basket and outer ring may be made of two pieces of injection molded plastic.

To further dampen imbalance caused by randomly positioned clothes in the spinning tub, known washing machines have utilized structure including shock absorbers mounted around a floating interior frame inside the washing machine casing whereby substantially the entire interior frame, motor, driving engagement, and tub are floatingly positioned inside the outer washing machine casing. While this structure damps the vibration caused during an imbalanced spin cycle, its complexity and cost of manufacture is high. A need has therefore arisen for a washing machine of simplified low cost construction embodying a molded spin basket with centrifugal water retaining ring and a machine support means which provides vibration damping characteristics equal to or superior than presently known in washing machines.

SUMMARY OF THE INVENTION

The invention is directed to a washing machine of the type having a casing, a clothes receiving tub rotatably mounted in the casing, a drive means mounted in said casing and drivingly connected to the clothes receiving tub and to an improvement comprising in combination: an imbalance compensating jacket surrounding the tub which is in fluid communication therewith; and a casing mounting support rigidly mounted at one end to the casing and including a vibration damping body positioned between the casing and a surface on which the washing machine is to be mounted.

The invention is further directed to a washing machine of the type having a clothes receiving tub including a frusto-conical sidewall being of greater diameter at its top than at its bottom, and having a plurality of holes adjacent the top of the sidewall providing fluid communication between the inside of the tub and the imbalance compensating jacket. The jacket includes an annular pocket having upper and lower inwardly extending lips. The upper lip extends over the top of the tub sidewall, and the lower lip distal edge provides the outer edge of an annular aperture between the jacket and main tub portion.

The invention is further directed to a washing machine of the type having a casing mounting support including flexible bar means for damping vibrations imparted to one end thereof. The bar includes rigid mounting means at that one end and the opposite end includes a resilient mounting pad for frictional retention on a surface to which the washing machine is mounted. The casing includes means for rigidly mounting the supports to the interior thereof in spatial relation above its bottom, and means for damping the movement of the casing relative the mounting support at a spatially related position below the rigid mounting means.

It is therefore an object of the invention to provide a washing machine having stabilization means with vibration damping characteristics equal or superior in performance to heretofore known stabilization means and which is provided at lower cost of manufacture.

Another object of the invention is to provide washing machine stabilization means of simplified construction such that the entire washing machine casing and spin basket may be made of injection molded plastic.

A further object of the invention is the provision of a simplified washing machine casing mounting structure which coacts with stabilization means in the washing machine tub to dampen vibration from tub loading imbalance.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

FIG. 1 is a perspective view, partially cut away, of an improved washing machine constructed in accordance with the present invention.

FIG. 2 is an enlarged cross-sectional view with portions shown in full of the washing machine taken substantially along line 2—2 of FIG. 1.

FIG. 3 is a cross-sectional view taken along line 3—3 of FIG. 2.

DETAILED DESCRIPTION OF THE INVENTION

Referring now to the drawings and particularly to FIG. 1 there is shown a washing machine 10 constructed in accordance with the invention. The washing machine includes a combination outer casing and supporting frame 11 which may be formed of conventional sheet metal or, in smaller washers, of injection molded plastic pieces. Casing 11 combines an outer decorative cover 12 which has pleasing aesthetic qualities as well as substantial washer support characteristics, together with an inner supporting platform framework 13 mounted between the cover sidewalls. Platform 13 secures the four walls together while providing mounting support for the operating portion of the washing machine. A standpipe 14 is mounted centrally on and extends above framework platform 13 through an aperture of like size therein. A drive shaft 15 is axially mounted through standpipe 14. The drive shaft 15 is mounted at one end to a prime mover 16, which is generally an electric motor of the type described in accordance with the disclosure of my co-pending application Ser. No. 489,405, which provides oscillatory and rotational motion to drive shaft 15. At the other end of drive shaft 15 a clothes receiving tub or spin basket 17 is mounted in fixed rotational relation thereto.

Clothes receiving tub 17 is preferably made of two pieces of injection molded plastic and includes, in this embodiment a central main agitator portion 20 positioned in fixed rotational relation to the remainder of tub 17. It can be understood that in differing embodiments the agitator 20 may be made and operated separately of the remainder of tub 17. Tub 17 also includes a bottom wall portion 21 and a frusto-conical inclined sidewall portion 22. At the top of sidewall 22 perforate holes 23—23 allow water inside the tub to move centrifugally outward therethrough during the spin cycle of the washing machine. A cylindrical pocket, retaining ring, or jacket 24 is positioned radially outwardly of sidewall 22 and retains water therein during the spin cycle as long as the tub rotation speed is above the critical velocity. An annular bottom wall 25 of ring 24 has an aperture 25a radially inwardly adjacent thereto through which water may exit the tub by means of gravity. Water thus exiting tub 17 is collected on platform 13 and exits therefrom through drain 29 which may be connected by piping, hose, or the like to a conventional drainage means.

The casing 11, tub 17, and drive mechanism 15 along with prime mover 16 are all supported by flexible vibration damping rod or bar members 26—26, each of which is rigidly mounted to one of four corners of casing 11 at the top 27 thereof, extends vertically downward through the casing, through framework platform 13, and ends mounted in rubber feet 28 which frictionally secure the washing machine to a floor or other mounting surface. Each vibration damping bar 26, while rigidly mounted to casing 11 at 27, is only loosely retained by frictional retaining means positioned at oversize aperture 31 through mounting platform framework 13, thereby allowing the bar 26 to flex and dampen the vibration commonly caused during the spin cycle of the washing machine. Since vibration is dampened through the flexible bar supports, the rubber feet 28—28 do not tend to creep or move during the spin cycle thereby stabilizing the entire washing machine.

Referring to FIGS. 2 and 3, the preferred embodiment of the invention may be readily described and shown in greater detail. The outer structure or cover 12 includes opposing sidewalls 31, 32 back wall 33, and front wall 34 which are generally rectangular in shape, positioned in vertical relation so as to form a box. A top wall 35 encloses the vertical walls and includes a generally rectangular aperture 36 in which a door 37 is hingedly mounted providing access to the interior of washing machine 10 and particularly to the clothes receiving tub 17. At the back of the top 35 is a conventional control panel 40 which includes the control dials generally associated with washing machines mounted thereon. The outer structure 12 of washing machine 10 may be made of a plurality of molded plastic pieces in a small washing machine or may be conventionally made of sheet metal in a standard size washing machine. While the outer structure is decorative and aesthetic, it also supplies strength and rigidity to the overall washing machine.

Inside of outer structure 12, the platform 13 and its acoutriments provide together with the outer structure, a water tight chamber in which the clothes receiving tub 17 is mounted, and through which fluid extracted from the tub must pass and proceed therefrom out drain 26. Platform framework 13 is rectangular and mounted in water-tight relation between the vertical walls of the outer structure 12. The platform mounting position is in spatial relation to the top 35 of the washing machine such that the clothes retaining tub 17 may be positioned therein; and in spatial relation to a floor on which the washing machine is to be positioned such that the prime mover, 16 may be mounted thereunder. In this embodiment, the platform 13 is generally flat although it may slope downward slightly to drain 29, and it includes a central aperture 41 in which the standpipe 14 is mounted in water-tight relation. The prime mover 16 is positioned by mountings 42—42 to the bottom of platform 13 such that the drive means or shaft 15 is positioned axially extending up the center of drain pipe 14. Drive shaft 15 is supported by bearings 43—43 on the prime mover and extends upwardly out of drain pipe 15 where it is mounted in fixed rotational relation at 44 to the center of clothes receiving tub 17, and particularly to the apex of the central agitator portion 20 of clothes receiving tub 17.

Agitator 20 is mounted in fixed rotational relation with tub 17 and includes a plurality of vanes 45—45 extending outwardly from a hollow central cylindrical portion 20a which substantially envelopes the standpipe 14 in drive shaft 15. The standpipe 14 eliminates a need for water seals between the tub 17 and drive shaft 15 or prime mover 16. In the preferred embodiment, central agitator portion 20 is integrally formed with the generally circular bottom 21 of tub 17, although it is understood that a separate tub and agitator could be utilized within the scope of the present invention. The frusto-conical sidewall 22 extends from the outer edge of bottom surface 21 to the top horizontal lip 46 of the tub 17. The inclined sidewall 22 is utilized during the spin cycle of the washer to move fluid outwardly and upwardly while the tub is spinning, thus extracting the fluid from the tub through a plurality of water exit holes 23 which extend through the sidewall adjacent the upper lip 46 thereof. The upper lip 46 prevents wash water from centrifuging over the top of the tub and assures extraction of the wash water through exit holes 23.

In the preferred embodiment, the upper lip 46 is extended outwardly to form the top wall **46*a* of the ring or jacket 24 which surrounds the tub 17. Jacket 24 has an upper wall 46, a sidewall 47, a lower wall 25, which in this embodiment, distally extends inwardly from the side wall 47, and interior baffles 51 which extend vertically across sidewall 47 at even intervals around the jacket. The purpose of the jacket 24 is to retain wash water therein which has been extracted through holes 23. The extracted water is forced against the jacket sidewall 47 during the spin or extraction cycle and tends to seek a position around the jacket so as to compensate for imbalance due to the random position of clothing in the tub after the wash cycle is completed. Wash water surge around the inside of jacket 24 is prevented by baffles 51. However, apertures 52—52 positioned at spaced intervals along each baffle 51 allow limited movement of wash water between baffles. The lower wall 25 of the jacket 24 is, in this embodiment, annular in structure and the interior edge thereof together with the external edge of tub bottom 21 define an annular aperture 25***a* through which wash water exits the jacket due to overfilling of the jacket or due to the rotating speed of the tub decreasing below a critical velocity. The critical velocity is reached when the centrifugal force retaining the wash water in the jacket becomes less than the gravatational force causing the water to fall downwardly therefrom. When wash water falls through the annular aperture, it is then exited from the platform 13 through water drain 29.

A plurality of second vibration damping structures are positioned inwardly adjacent each of the four vertical corners of the washing machine outer structure 12. This second structure includes four vibration flexible damping supporting rods or bars 26 which extend substantially vertically through the washing machine 10 and support the washing machine on the surface to which it is to be positioned. In order to seal the supporting bars 26—26 from the water extracted from the tub 17, interior sidewalls 53, 54, 55, and 56 are positioned at 45° angles to the outer vertical walls and are inwardly spatially related from the four vertical outer structure corners. The inner sidewalls sealingly engage the sidewalls, front, and back wall and the platform 13 in water-tight manner so as to provide a dry space or pocket at each corner in which the vibration damping support bars 26 are mounted.

A substantial means for rigidly mounting each support bar 26 to the casing 11 is solidly mounted to the inside surface of the top 35 of the washing machine at each corner thereof. In this embodiment, a solid triangular shape block 57 is mounted at the upper end of each triangular shape pocket. A threaded aperture 58 centrally vertically oriented in each mounting block 57 provides a means for rigidly securing a complementary threaded end at the top of each support bar 26. Each support bar 26 then extends vertically downward through the washing machine and through an oversized aperture 31 in the framework platform 13. Each oversize aperture 31 is substantially larger in diameter than the diameter of the support bar 26 for assuring a relatively unhampered ability to deflect and bend so as to dampen vibrations imparted to the upper rigidly mounted end thereof.

Each support bar 26 terminates in a threaded end which adjustably threadedly engages a rubber foot 28. It should be noted that while the lower end of flexible bar 26 is considered a free end relative the washing machine, it is not free to vibrate, but is preferably motionless when mounted on a floor or other surface. When the machine 10 is positioned on a floor, it is the top rigidly mounted end which may vibrate. Resilient friction pads 64, each including a central aperture 64*a*, are mounted to the bottom of framework platform 13. The aperture 64a is positioned in axial alignment below each friction pad 64. Apertures 62 and 64*a* are of sufficient size to slidably receive a support bar 26 positioned therethrough. A coil spring 63, through which support bar 26 also passes, biases disc 61 against friction pad 64 with a force determined by the adjustment of retaining nut 65 which is of a self-locking type. Relative movement between metal disc 61 and the friction pad 64 results in damping of such motion and in dissipation of the energy causing such motion.

A combination of vibration damping means in the clothes receiving tub 17 at the water retaining jacket 24, and the vibration damping means of flexible support bar 26 mounted at each corner of washing machine 10 provide a total vibration damping ability which is equal to or greater than that found in known washing machines of like size. Also, the simplicity of construction of the washing machine allows at least a substantial portion of same to be formed of injection molded plastic pieces. Thus providing a washing machine manufactured at a substantial saving in production cost.

While one embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

I claim:

1. In a washing machine of the type having a structural framework and an outer covering mounted thereto which together define a box-like casing having four vertical corners and a generally rectangular horizontal top surface with an access door hingedly positioned centrally therein and a substantially vertical control panel extending upwardly from the back thereof, a vertically axially oriented injection molded plastic clothes receiving tub rotatably mounted on said structural framework and enclosed by said outer covering; said tub including a main tub portion including a bottom wall and an integral inclined frusto-conical sidewall for retaining fluid therein, an agitator portion centrally fixedly positioned therein;

an electric motor mounted to said framework;

drive means connecting said motor and said tub;

and an improvement comprising in combination:

a fluid retaining jacket surrounding said main tub portion and in fluid communication therewith for obtaining fluid extracted therefrom and retaining said fluid therein by centrifugal force to counteract loading imbalances in said tub during rotation of same; and a plurality of vertically oriented flexible casing mounting support bars, each bar being elongated, and including opposed top and bottom ends adapted for mounting to external members, each of said bars being rigidly mounted at its top end to said casing inwardly adjacent one of said vertical corners and the top surface of said casing, extending substantially freely downwardly through frictional damping means on said casing; and including foot pads of resilient material mounted on its bottom end for providing frictional contact with a mounting surface for said washing machine.

2. The washing machine of claim 1 wherein said inner structural framework includes a mounting platform positioned across the interior of said washing machine in fluid tight relation thereto, said platform including a standpipe extending vertically therefrom through which said drive means is positioned, motor mounting means, a fluid drain, and support bar movement damping means positioned inwardly adjacent the corners thereof for limiting the movement of the lower portion of said bars relative said mounting platform; and water confining partitions positioned inwardly adjacent said support bars and the corners of said outer covering for sealing said support bars from fluid extracted from said tub.

3. The washing machine of claim 2 wherein said support bar movement limiting means includes an aperture through said platform through which said support bar passes, said aperture being of greater diameter than the diameter of said bar for permitting relative movement therebetween; and frictional damping means between said aperture and said bar for damping relative vibration therebetween.

4. The washing machine of claim 3 wherein said support bar movement limiting means further includes spring means for centrally biasing said support bar relative said aperture in said mounting platform.

5. The washing machine of claim 1 wherein said main tub portion includes a radially inwardly extending lip at the top thereof for preventing fluid flow over the top of said tub sidewall, and apertures through said sidewall adjacent said lip for extraction of fluid outwardly therethrough;

and wherein said fluid retaining jacket includes an annular centrifugal fluid retainer having a C-shape cross section, the top of said retainer being mounted outwardly adjacent the lip of said tub, the bight portion of said retainer being capable of retaining fluid therein when said tub is spinning above critical velocity, and the bottom of said retainer being open for allowing fluid to flow out thereof by gravitational means.

6. In a washing machine of the type having a structural framework and an outer covering mounted thereto which together define a box-like casing having four vertical corners and a generally rectangular horizontal top surface with an access door hingedly positioned centrally therein and a substantially vertical control panel extending upwardly from the back thereof, a vertically axially oriented clothes receiving tub rotatably mounted on said structural framework and enclosed by said outer covering; said tub including a main tub portion including a bottom wall and an integral inclined frusto-conical sidewall for retaining fluid therein, an agitator portion centrally fixedly positioned therein;

an electric motor mounted to said framework;

drive means connecting said motor and said tub;

and an improvement comprising in combination:

a fluid retaining jacket surrounding said main tub portion and in fluid communication therewith for obtaining fluid extracted therefrom and retaining said fluid therein by centrifugal force to counteract loading imbalances in said tub during rotation of same; and a plurality of vertically oriented flexible casing mounting support bars, each being elongated, and including opposed top and bottom ends adapted for mounting to external members, each of said bars being rigidly mounted at its top end to said casing inwardly adjacent one of said vertical corners and top surface of said casing, extending substantially freely downwardly through frictional damping means on said casing; and including foot pads of resilient material mounted on its bottom end for providing frictional contact with a mounting surface for said washing machine.

7. The washing machine of claim 6 wherein said inner structural framework includes a mounting platform positioned across the interior of said washing machine in fluid tight relation thereto, said platform including a standpipe extending vertically therefrom through which said drive means is positioned, motor mounting means, a fluid drain, and support bar movement damping means positioned inwardly adjacent the corners thereof for limiting the movement of the lower portion of said bars relative said mounting platform; and water confining partitions inwardly adjacent said support bars and the corners of said outer covering for sealing said support bars from fluid extracted from said tub.

8. The washing machine of claim 7 wherein said support bar movement limiting means includes an aperture through said platform through which said support bar passes, said aperture being of greater diameter than the diameter of said bar for permitting relative movement therebetween; and frictional damping means between said aperture and said bar for damping relative vibration therebetween.

9. The washing machine of claim 8 wherein said support bar movement limiting means further includes spring means for centrally biasing said support bar relative said aperture in said mounting platform.

10. The washing machine of claim 6 wherein said main tub portion includes a radially inwardly extending lip at the top thereof for preventing fluid flow over the top of said tub sidewall, and apertures through said sidewall adjacent said lip for extraction of fluid outwardly therethrough;

and wherein said fluid retaining jacket includes an annular centrifugal fluid retainer having a C-shape cross section, the top of said retainer being mounted outwardly adjacent the lip of said tub, the bight portion of said retainer being capable of retaining fluid therein when said tub is spinning above critical velocity, and the bottom of said retainer being open for allowing fluid to flow out thereof by gravitational means.

* * * * *